US007845100B2

(12) United States Patent
Bier et al.

(10) Patent No.: US 7,845,100 B2
(45) Date of Patent: Dec. 7, 2010

(54) SET OF IDENTIFICATION PLATES

(75) Inventors: Klaus-Dieter Bier, Leutenbach (DE); Thomas Gangl, Mainhardt (DE)

(73) Assignee: Murrplastik Systemtechnik GmbH, Oppenweiler (DE)

( * ) Notice: Subject to any disclaimer, the term of this patent is extended or adjusted under 35 U.S.C. 154(b) by 252 days.

(21) Appl. No.: 12/086,027

(22) PCT Filed: Nov. 15, 2006

(86) PCT No.: PCT/EP2006/010932

§ 371 (c)(1),
(2), (4) Date: Jun. 4, 2008

(87) PCT Pub. No.: WO2007/065532

PCT Pub. Date: Jun. 14, 2007

(65) Prior Publication Data

US 2009/0277062 A1 Nov. 12, 2009

(30) Foreign Application Priority Data

Dec. 6, 2005 (DE) ..... 10 2005 058 387

(51) Int. Cl.
*G09F 11/02* (2006.01)

(52) U.S. Cl. ..... 40/475; 40/473; 40/411

(58) Field of Classification Search ..... 40/111, 40/229.01, 633, 641
See application file for complete search history.

(56) References Cited

FOREIGN PATENT DOCUMENTS

| | | |
|---|---|---|
| DE | 10 55 640 | 4/1959 |
| DE | 1 847 049 | 2/1962 |
| DE | 18 47 049 | 2/1962 |
| DE | 34 43 170 | 5/1986 |
| DE | 88 06 304 | 8/1988 |
| DE | 37 25 217 A1 | 2/1989 |
| DE | 37 25 217 C2 | 2/1989 |
| DE | 90 06 410 | 8/1990 |
| DE | 42 39 434 | 5/1994 |
| EP | 0 752 693 | 1/1997 |
| EP | 15 96 351 | 11/2005 |

OTHER PUBLICATIONS

International Search Report.

*Primary Examiner*—Lesley Morris
*Assistant Examiner*—Shin Kim
(74) *Attorney, Agent, or Firm*—Collard & Roe, P.C.

(57) ABSTRACT

The invention relates to a set of identification plates (10) with inscribable identification plates (16) lying in a plane. According to the invention, a central carrier (12) is provided and has at least one elongated side carrier (14) integrally formed on it with one of its narrow sides respectively on two sides facing away from each other, wherein at least one of the side carriers (14) carries at least one identification plate (16) on at least one of its longitudinal sides.

21 Claims, 6 Drawing Sheets

SET OF IDENTIFICATION PLATES

CROSS REFERENCE TO RELATED APPLICATIONS

Figures 1, 2, 3:
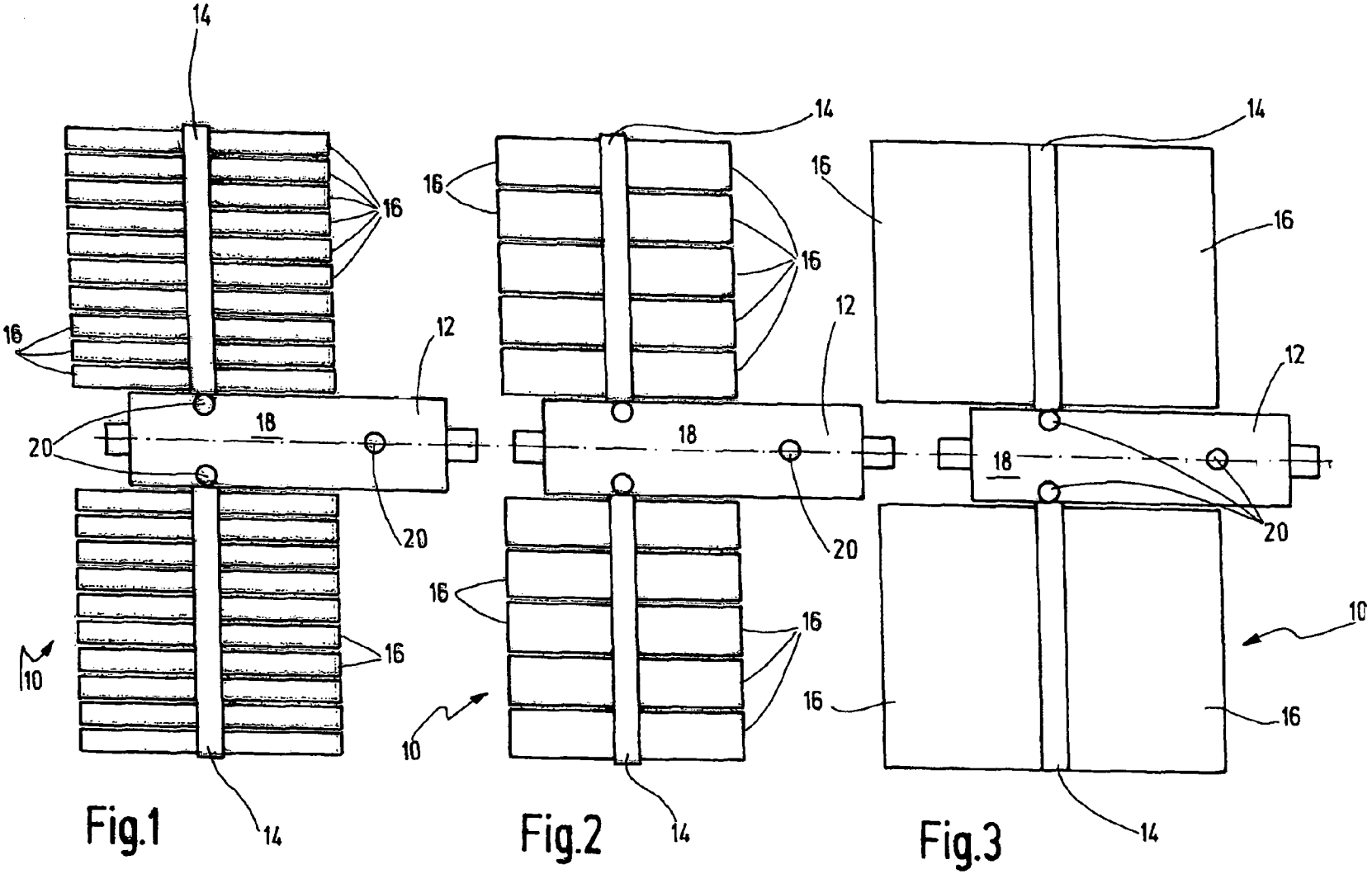

This application is the National Stage of PCT/EP2006/010932 filed on Nov. 15, 2006, which claims priority under 35 U.S.C. §119 of German Application No. 10 2005 058 387.3 filed on Dec. 6, 2005. The international application under PCT article 21(2) was not published in English.

The invention relates to a set of identification plates having inscribable identification plates that lie in a plane, in accordance with the preamble of claim 1, and to an arrangement of a plurality of sets of identification plates in accordance with the preamble of claim 13, respectively.

Such sets of identification plates, as they are known from DE 42 39 434 A1, for example, have a plurality of identification plates that are releasably attached to carriers, and form a span in a plane. The identification plates primarily serve to identify electrical components, for example to identify cables. The identification plates are combined into a set of identification plates, so that they can be better laid into an inscription device for inscribing. In the inscription device, all the identification plates of a set of identification plates can be inscribed in a single work step. Subsequently, the individual identification plates are taken out of the set of identification plates and used for identification. Furthermore, a strand is known from DE 42 39 434 A1, which consists of multiple sets of identification plates strung together, and is configured so that it can be rolled. The identification plates are affixed at crosspieces that extend between two longitudinal frame strips that run parallel. Each crosspiece carries identification plates only on one of its longitudinal sides. As a result, this structure is relatively complicated and the packing density of the identification plates is low. Furthermore, it is true that the strand can be configured as an endless strand that can be drawn into an inscription device by way of an intake device, for automatic inscription. However, for this purpose it has to be wound up onto a roll, and this takes up space.

It is therefore the task of the invention to further develop a set of identification plates and/or an arrangement of a plurality of sets of identification plates of the type stated initially, in such a manner that they are structured more simply, i.e. can be stored in space-saving manner.

This task is accomplished, according to the invention, by means of a set of identification plates having the characteristics of claim 1, and by an arrangement of a plurality of sets of identification plates having the characteristics of claim 10. Advantageous further developments of the invention are the object of the dependent claims.

The set of identification plates according to the invention, according to claim 1, is based on the idea that a simpler and less material-intensive structure is provided by forming the side carriers onto the central carrier, whereby at least one side carrier carries the identification plates on its longitudinal side or on both longitudinal sides. Furthermore, high packing density of the identification plates can be achieved by means of arranging the identification plates on both longitudinal sides of the side carriers.

The central carrier is preferably an elongated plate, whereby the side carriers are formed onto the longitudinal sides of the central carrier. It is practical if the set of identification plates then has a plane of symmetry that runs in the longitudinal direction of the central carrier. Then, the same number of identification plates is affixed on both sides of the central carrier, in the same geometrical arrangement. It is preferred that the central carrier has slanted or rounded corners, at least on one of its narrow sides. These serve as introduction bevels when the set of identification plates is drawn into an inscription device by machine. It is advantageous if the central carrier has a planar inscription surface for affixing an inscription. Furthermore, it is practical if the central carrier has at least one holder hole for setting it onto a holder mandrel. This facilitates automatically drawing the set of identification plates into an inscription device. There, the central carrier can be provided, on its inscription surface, with an inscription that characterizes the set of identification plates, which inscription is not supposed to appear on the identification plates.

It is preferred that the set of identification plates consists of one piece, preferably of plastic. In this way, it can be produced in particularly simple manner, using an injection-molding method or an extrusion method. Furthermore, it is also possible to produce the set of identification plates in one piece from metal, if necessary. In order to be better able to remove the individual identification plates, it is practical if planned breaking points are provided between them and the side carriers. Furthermore, planned breaking points can also be situated between the side carriers and the central carrier. This facilitates removal of the side carriers with the formed-on identification plates from the central carrier.

According to an advantageous embodiment, it is provided that the identification plates of each of the side carriers are disposed symmetrical to one another with reference to a plane of symmetry that extends in the longitudinal direction of the side carrier. This is particularly advantageous if the identification plates are used to identify cables that carry an identification plate at each of their ends. Then, it is advantageous if the identification plates disposed on a side carrier, opposite one another on the two longitudinal sides, are used to identify a cable.

It is advantageous if the side carriers have a continuation that does not carry an identification plate at their ends, in each instance. A hold-down of an inscription device can engage on this, to press the set of identification plates onto a support plane during an inscription process. It is practical if the continuation is thinner than the remaining part of the side carrier, in each instance.

The arrangement of identification plates according to the invention, according to claim 13, is based on the idea that the strand can be folded, according to the principle of an accordion fold, to save space, because the adjacent central carriers can be pivoted until they preferably lie flat on one another. In this connection, it can furthermore continue to be possible to roll the strand up onto a roll, if this is necessary. In both cases, the identification plates of the strand can be drawn into an inscription device using an automated method, and inscribed there. After inscription, the individual sets of identification plates are separated from one another. For this purpose, it is preferred that the central carriers are connected with one another in one piece. It is practical if the joints form planned breaking points for removing the sets of identification plates from the strand.

It is particularly preferred that the arrangement consists of sets of identification plates according to one of claims 1 to 12. If the central carrier of each set of identification plates is an elongated plate, it is preferred that the central carriers are connected with one another at their narrow sides.

It is practical if the arrangement of identification plates is produced in one piece, for example as an injection-molded part, as an extruded plastic part, as a part punched from a sheet, or as a plastic part with an injected film at the back. To implement the accordion-fold principle, it is sufficient if the central carriers that follow one another in a strand can be alternately pivoted, relative to one another, in two opposite directions that stand perpendicular to the plane spanned by the identification plates. However, it is preferred that the central carriers can be pivoted, relative to one another, about each joint, in two opposite directions that stand perpendicular to the plane spanned by the identification plates.

It is advantageous if the identification plates are disposed on each longitudinal side of the side carriers, at a distance from one another that corresponds to at least their width, and the identification plates of two sets of identification plates that follow one another in the row engage into one another in zipper-like manner. In this way, a particularly high packing density with only small interstices between the identification plates is achieved. The identification plates of at least one of the sets of identification plates can extend, at least partially, so far in the longitudinal direction of the strand, that their ends lie next to the central carrier of the next set of identification plates following in the row. When the sets of identification plates are cut at the joints, by a cutting device, this device can then, at the same time, cut off the ends of the identification plates lying next to the central carrier of the following set of identification plates, if these have to be shortened. However, it is also possible that the identification plates of at least one of the sets of identification plates extend, at least partly, in the longitudinal direction of the row, maximally all the way to the beginning of the central carrier of the next set of identification plates following in the row. Here, removal of a set of identification plates by means of a cutting tool can take place, without the identification plates being shortened.

Figure 4:
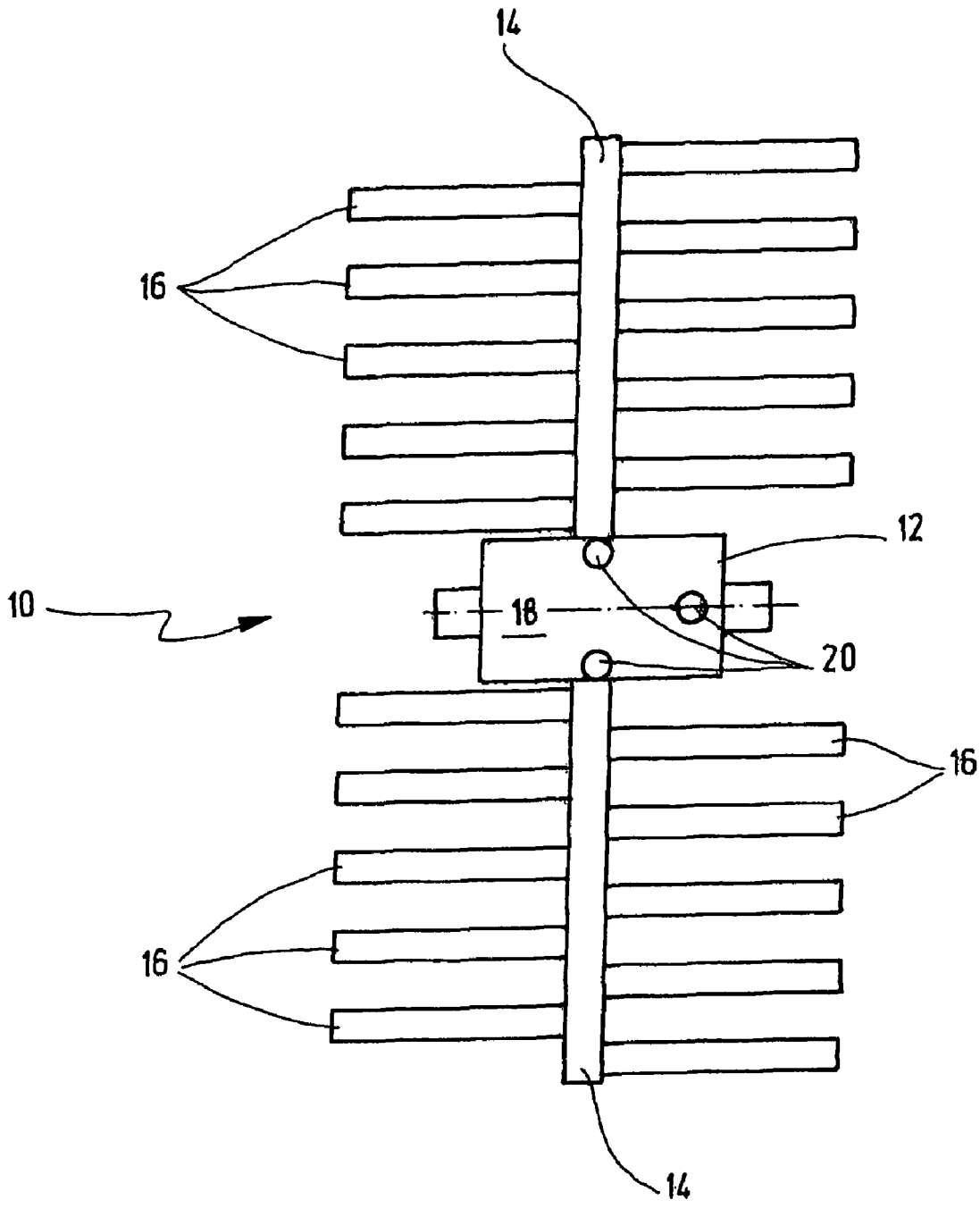
Figure 5:
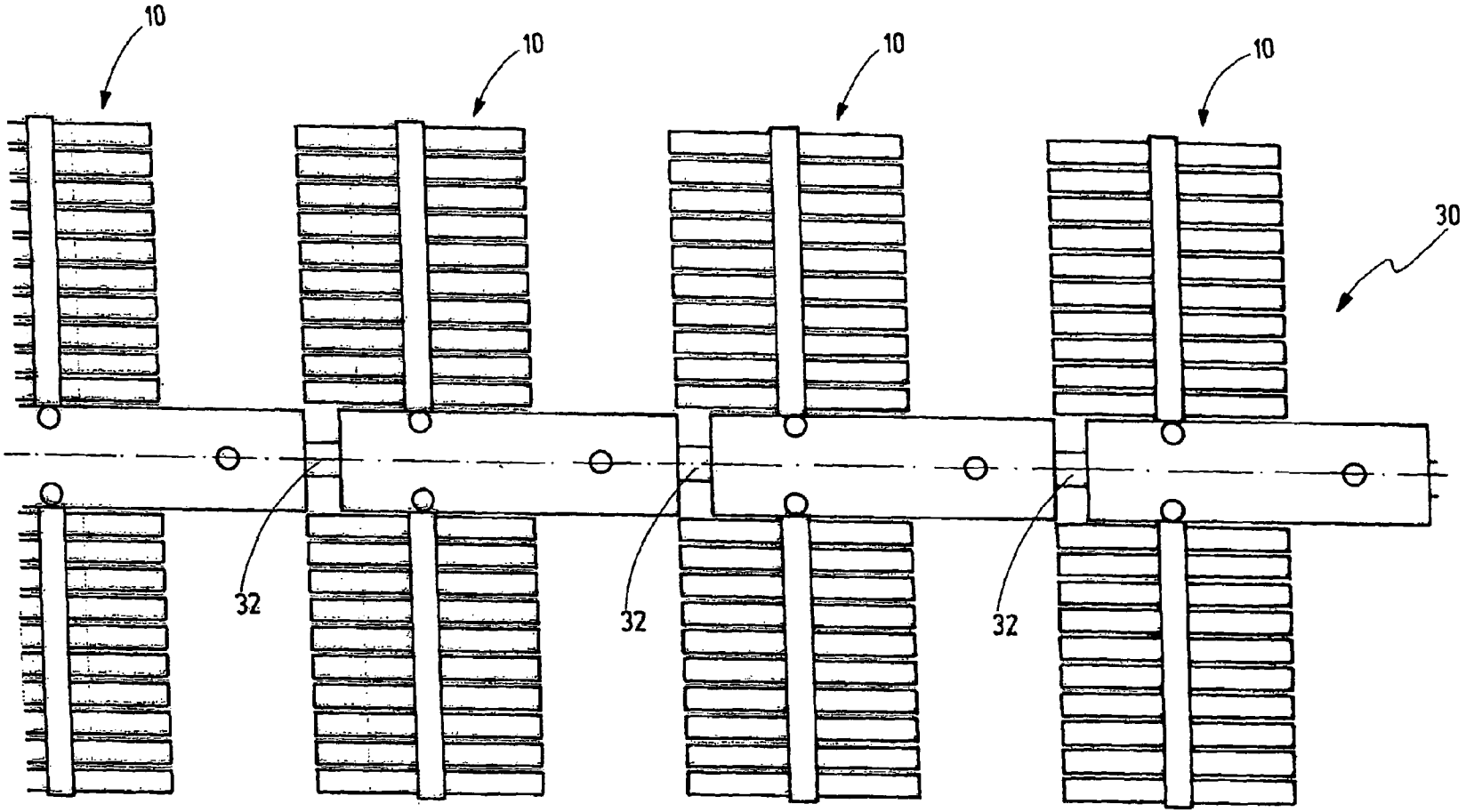
Figure 6:
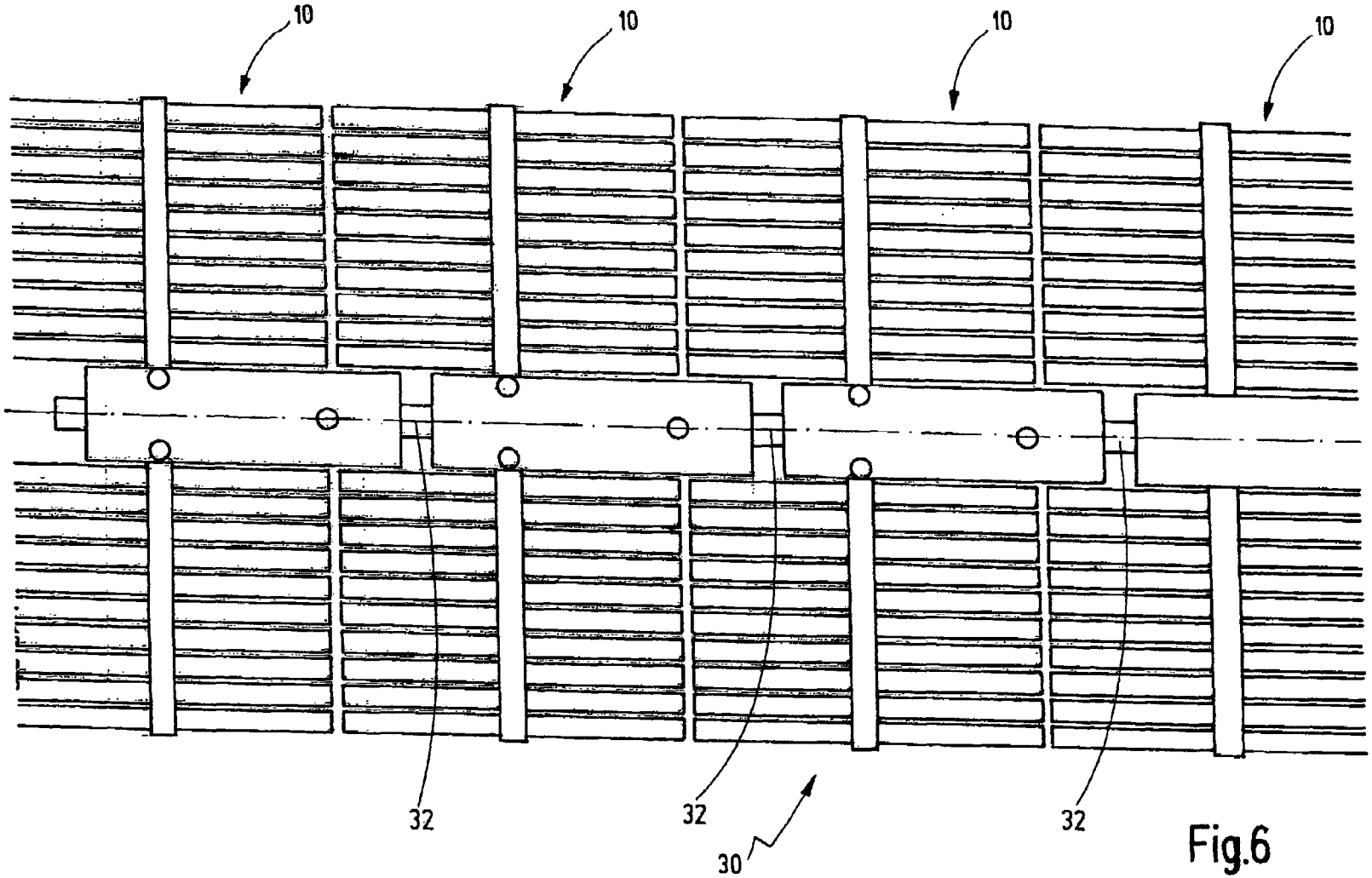
Figure 7:
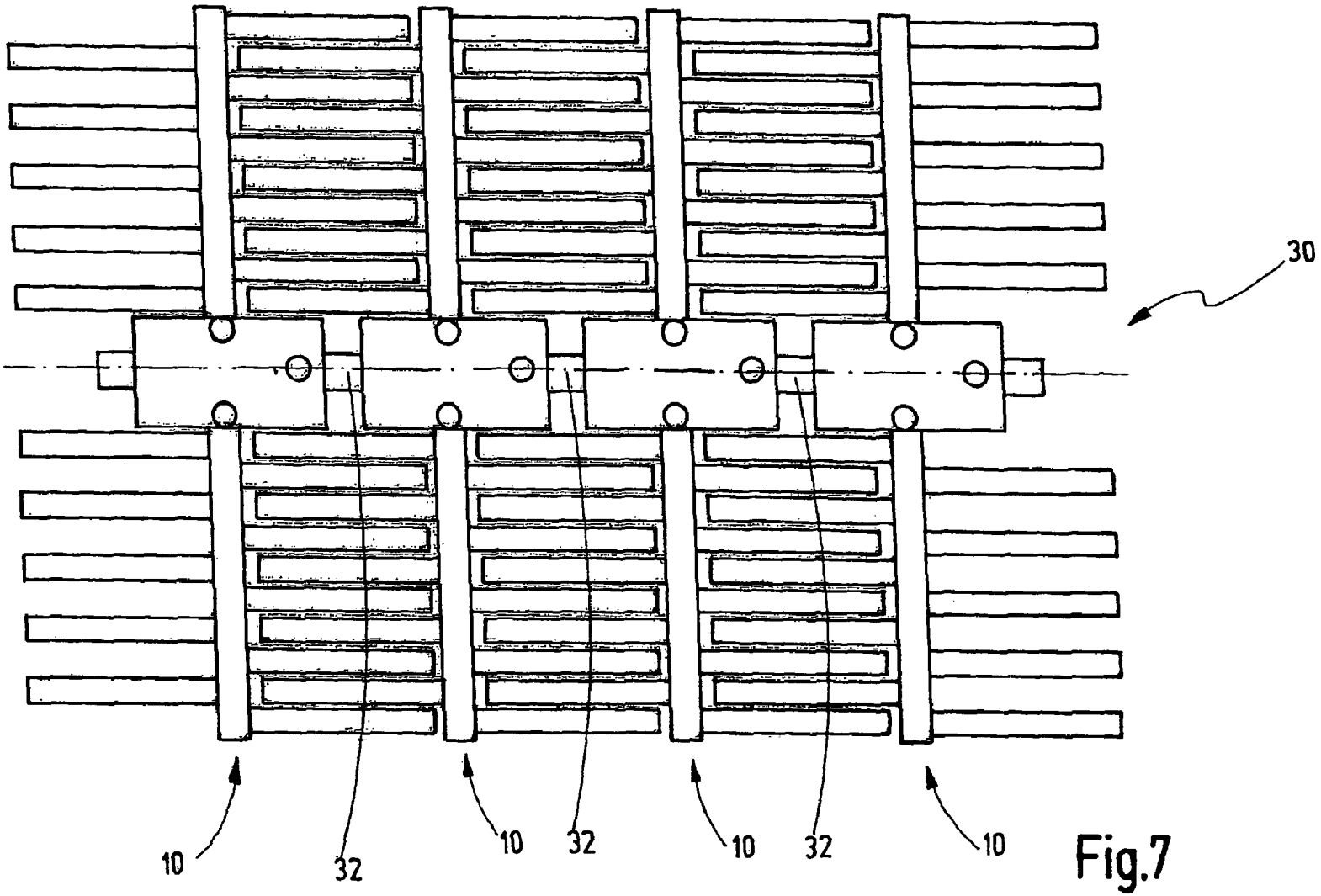
Figure 8:
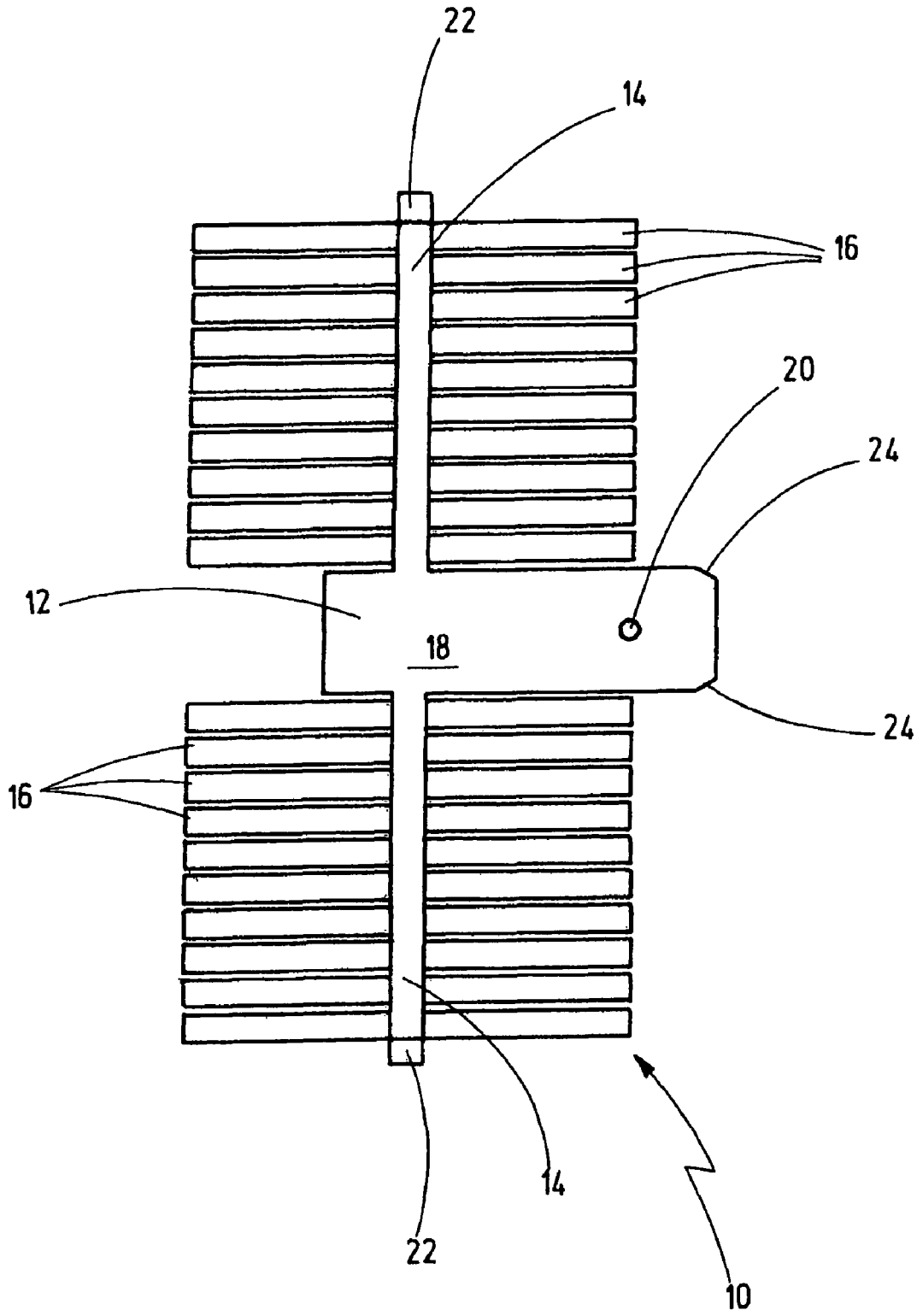

In the following, the invention will be explained in greater detail using exemplary embodiments shown in the drawing. This shows:

FIGS. 1 to 4 and 8 five exemplary embodiments of a set of identification plates in a top view, and FIG. 5 to 7 three exemplary embodiments of an arrangement of sets of identification plates that form a strand.

A set 10 of identification plates according to FIGS. 1 to 4 has a central carrier 12 configured as an elongated plate, from the longitudinal sides of which plate, which face away from one another, a side carrier 14 extends, in each instance. In this connection, the longitudinal axis of each of the side carriers 14 runs perpendicular to the longitudinal axis of the central carrier 12. Identification plates 16 are formed onto the side carriers 14, on their longitudinal sides, which plates are connected with the side carriers 14 by way of a planned breaking point, in each instance. The identification plates 16 are spanned in a plane, so that they can be jointly inscribed in an inscription device. Their inscription surfaces, which are shown in the top views according to FIG. 1 to 4, lie in a plane with an inscription surface 18 of the central carrier 12. In all four exemplary embodiments, the set 10 of identification plates, in each instance, is symmetrical with reference to a plane of symmetry that runs through the longitudinal axis of the central carrier, perpendicular to the inscription surface 18. In the case of the first three exemplary embodiments according to FIG. 1 to 3, the identification plates 16 are also disposed symmetrical with reference to another plane of symmetry, which runs through the longitudinal axis of the side carriers 14, perpendicular to the plane spanned by the identification plates 16. The sets 10 of identification plates of the first three exemplary embodiments differ from one another merely in the number and size of the identification plates.

The identification plates 16 of the set 10 of identification plates according to FIG. 4 are not disposed symmetrically with reference to the plane that runs along the side carriers 14. Five identification plates 16 are formed onto each longitudinal side of the side carriers 14, and disposed relative to one another at a distance that is slightly greater than their width. On the opposite longitudinal side, five identification plates 16 are also formed on, at a distance from one another. These are situated at the level of a gap between the identification plates 16 of the other longitudinal side, in each instance.

Sets 10 of identification plates, as shown in FIGS. 1 to 4, can form a strand 30, as shown in FIG. 5 to 7. For this purpose, a plurality of sets 10 of identification plates is disposed in a row, so that the longitudinal axes of their central carriers 12 coincide. Two sets 10 of identification plates that follow one another in the row are connected with one another by way of a joint 32, in each instance, which allows pivoting of the sets 10 of identification plates relative to one another, until their central carriers 12 lie flat on one another. The joints 32 allow pivoting in both directions perpendicular to the plane spanned by the identification plates 16, in other words into the plane of the drawing and out of the plane of the drawing, in each instance, in FIGS. 5 to 7. In this way, the strand can be folded in an accordion fold. The entire strand is produced in one piece, as an injection-molded part or by means of extrusion. In this connection, the joints 32, which are structured to be thinner than the central carriers 12, serve as planned breaking points for removing individual sets 10 of identification plates from the strand 30.

In the case of the strand 30 according to FIG. 5, the identification plates 16 of the set 10 of identification plates that project to the left from the side carriers 14 only extend to the beginning of the central carrier 12 of the adjacent set of identification plates. In this way, it is possible to separate the individual sets of identification plates from one another in the region of the joint 32, by means of a cutting tool that is set on perpendicular to the longitudinal axis of the central carriers 12, without thereby also cutting off the ends of the identification plates 16.

In this point, the strand 30 according to FIG. 6 differs. Its identification plates 16 of each set 10 of identification plates, which project to the left from the side carriers 14, extend so far in the longitudinal direction of the strand that their ends are situated next to the central carrier 12 of the adjacent set of identification plates. In this way, it is possible to shorten half of the identification plates 16 in one work step, by means of a cutting tool, when removing the sets 10 of identification plates.

The strand 30 according to FIG. 7 is composed of sets of identification plates according to FIG. 4. Their central carriers 12 are shorter than the central carriers of the sets of identification plates according to FIGS. 1 to 3. In this way, the identification plates 16 of sets 10 of identification plates that follow one another in a row engage into one another in zipper-like manner, so that a high packing density of the identification plates 16 occurs.

In all the exemplary embodiments, the central carriers 12 are provided with holder holes 20, so that they can be set onto holder mandrels, which facilitates automatically drawing them into an inscription device, for example. For this purpose, a whole-number multiple of the distance between two holder holes 20 of sets 10 of identification plates that follow one another in a row corresponds to the distance between two consecutive holder mandrels of the inscription device.

The set 10 of identification plates according to the fifth exemplary embodiment (FIG. 8) corresponds, in terms of its structure, essentially to that of the first exemplary embodiment (FIG. 1). Therefore, characteristics that correspond to one another are provided with the same reference symbols. The set 10 of identification plates according to FIG. 8 has a continuation 22, in each instance, at the ends of the side carriers 14, which does not carry an identification plate 16.

The continuation 22 is thinner than the section of the side carrier 14 that carries the identification plates 16, and serves as an engagement point for a hold-down for pressing the set 10 of identification plates onto a support plane of an inscription device. Furthermore, the central carrier 12 has slanted corners 24 on one of its narrow sides, which form introduction bevels when the set 10 of identification plates is drawn into a guide rail of an inscription device, by means of a mechanical intake.

In summary, the following should be stated:

The invention relates to a set of identification plates having inscribable identification plates 16 that lie in a plane. According to the invention, a central carrier 12 is provided, onto which at least one elongated side carrier 14 is formed with one of its narrow sides, on two sides that face away from one another, in each instance, whereby at least one of the side carriers 14 carries at least one identification plate 16 on at least one of its longitudinal sides.

The invention claimed is:

1. A plate device comprising:

(a) a central carrier having a first side, a second side facing away from the first side, and a first longitudinal axis;

(b) a first elongated side carrier having a first narrow side, a first longitudinal side, and a second longitudinal axis, the first elongated side carrier being formed on the first side of the central carrier via the first narrow side; and (c) a second elongated side carrier having a second narrow side, a second longitudinal side, and a third longitudinal axis, the second elongated side carrier being formed on the second side of the central carrier via the second narrow side; and (d) a first inscribable identification plate carried on the first longitudinal side of the first elongated side carrier;

wherein the first longitudinal axis is not parallel to the second longitudinal axis; and wherein the first longitudinal axis is not parallel to the third longitudinal axis.

2. The plate device according to claim 1, further comprising a second inscribable identification plate carried on a second longitudinal side of the first elongated side carrier;

a second elongated side carrier having a second narrow side a third longitudinal side, and a fourth longitudinal side, the second elongated side carrier being formed on the second side of the central carrier via the second narrow side;

a third inscribable identification plate carried on the third longitudinal side of the second elongated side carrier; and a fourth inscribable identification plate carried on the fourth longitudinal side of the second elongated side carrier.

3. The plate device according to claim 2, wherein the first and second inscribable identification plates are disposed symmetrical to one another with reference to a first plane of symmetry extending in a first longitudinal direction of the first elongated side carrier; and wherein the third and fourth inscribable identification plates are disposed symmetrical to one another with reference to a second plane of symmetry extending in a second longitudinal direction of the second elongated side carrier.

4. The plate device according to claim 1, wherein the central carrier is an elongated plate, and wherein the first side of the central carrier is a first longitudinal side and the second side of the central carrier is a second longitudinal side.

5. The plate device according to claim 4, wherein the central carrier has a plane of symmetry running in a longitudinal direction of the central carrier.

6. The plate device according to claim 4, wherein the central carrier has a central carrier narrow side; and wherein the central carrier narrow side has slanted or rounded corners.

7. The plate device according to claim 1, wherein the central carrier has a planar inscription surface for affixing an inscription.

8. The plate device according to claim 1, wherein the central carrier has at least one holder hole for being set onto a holder mandrel.

9. The plate device according to claim 1, wherein the plate device is one piece.

10. The plate device according to claim 1, further comprising planned breaking points between the first inscribable identification plate and the first elongated side carrier and/or between the first elongated side carrier and the central carrier.

11. The plate device according to claim 1, wherein the first elongated side carrier has a first continuation at a third narrow side of the first elongated side carrier, the first continuation not carrying an identification plate; and wherein the second elongated side carrier has a second continuation at a fourth narrow side of the second elongated side carrier, the second continuation not carrying an identification plate.

12. The plate device according to claim 11, wherein the first continuation is thinner than a first section of the first longitudinal side of the first elongated side carrier, the first section carrying the first inscribable identification plate; and wherein the second continuation is thinner than a second section of the third longitudinal side of the second elongated side carrier, the second section carrying the third inscribable identification plate.

13. An arrangement forming a strand, the arrangement comprising:

(a) a first central carrier made of flat material and having a first side and a second side facing away from the first side;

(b) first inscribable identification plates lying in a first plane and carried by the first central carrier on the first side and on the second side;

(c) a second central carrier made of flat material and having a third side and a fourth side facing away from the third side;

(d) second inscribable identification plates lying in a second plane and carried by the second central carrier on the third side and on the fourth side;

(e) a first joint connecting the first central carrier and the second central carrier so that the first and second central carriers can be pivoted relative to one another from being in a row until the first and second central carriers come to lie on one another;

(f) a first elongated side carrier arranged on the first side of the first central carrier via a first narrow side of the first elongated side carrier, the first elongated side carrier having first and second longitudinal sides;

(g) a second elongated side carrier arranged on the second side of the first central carrier via a second narrow side of the second elongated side carrier, the second elongated side carrier having third and fourth longitudinal sides;

(h) a third elongated side carrier arranged on the third side of the second central carrier via a third narrow side of the third elongated side carrier, the third elongated side carrier having fifth and sixth longitudinal sides; and (i) a fourth elongated side carrier arranged on the fourth side of the second central carrier via a fourth narrow side of the fourth elongated side carrier, the fourth elongated side carrier having seventh and eighth longitudinal sides;

wherein the first, second, third, and fourth longitudinal sides carry the first inscribable identification plates; and wherein the fifth, sixth, seventh, and eighth longitudinal sides carry the second inscribable identification plates.

14. The arrangement according to claim 13, wherein the first and second central carriers are connected with one another in one piece.

15. The arrangement according to claim 14, wherein the arrangement is an injection-molded part, an extruded part, a part punched from a sheet, or a plastic part with an injected film at a back of the arrangement.

16. The arrangement according to claim 13, wherein the first joint forms planned breaking points for removing the first central carrier from the second central carrier.

17. The arrangement according to claim 13, wherein the first and second central carriers can be pivoted, relative to one another, about the first joint, in two opposite directions perpendicular to a first plane, the first and second inscribable identification plates being located in the first plane when the first and second central carriers are located in the row.

18. The arrangement according to claim 13, wherein the first and second central carriers can alternately be pivoted, relative to one another, in two opposite directions perpendicular to a first plane, the first and second inscribable identification plates being located in the first plane when the first and second central carriers are located in the row.

19. The arrangement according to claim 13, wherein the first and second inscribable identification plates are disposed on the first, second, third, fourth, fifth, sixth, seventh, and eighth longitudinal sides of the first, second, third, and fourth elongated side carriers, respectively, at a respective distance from other of the first or second inscribable identification plates on the respective first, second, third, fourth, fifth, sixth, seventh, and eighth longitudinal sides, the respective distance corresponding at least to a width of the respective first and second inscribable identification plates, and wherein the first inscribable identification plates on the second and fourth longitudinal sides of the first and second elongated side carriers, respectively, engage into the second inscribable identification plates on the fifth and seventh longitudinal sides of the third and fourth elongated side carriers, respectively, in zipper-like manner.

20. The arrangement according to claim 13, wherein the first inscribable identification plates extend, at least partly, so far in a longitudinal direction of the strand that ends of the first inscribable identification plates lie next to the second central carrier.

21. The arrangement according to claim 13, wherein the first inscribable identification plates extend, at least partly, in a longitudinal direction of the strand, maximally to a beginning of the second central carrier.

* * * * *